US007044067B2

(12) United States Patent
Saccomandi

(10) Patent No.: US 7,044,067 B2
(45) Date of Patent: May 16, 2006

(54) DECORATIVE TABLE COVERING

(76) Inventor: Diane C. Saccomandi, 628 Swarthmore Ave., Folsom, PA (US) 19033

( * ) Notice: Subject to any disclaimer, the term of this patent is extended or adjusted under 35 U.S.C. 154(b) by 8 days.

(21) Appl. No.: 10/620,141

(22) Filed: Jul. 15, 2003

(65) Prior Publication Data

US 2005/0013967 A1 Jan. 20, 2005

(51) Int. Cl.
*B32B 3/02* (2006.01)

(52) U.S. Cl. ..... 108/90; 428/123; 428/131; 428/192; 150/158

(58) Field of Classification Search ..... 428/99, 428/123, 192, 131; 108/90; 150/158
See application file for complete search history.

(56) References Cited

U.S. PATENT DOCUMENTS

| | | | |
|---|---|---|---|
| 1,142,571 | A | 6/1915 | Hoffberg |
| 1,219,790 | A | 3/1917 | Taylor |
| 1,326,746 | A | 12/1919 | Kunath |
| 1,684,173 | A | 9/1928 | Diamond et al. |
| 1,856,799 | A | 5/1932 | Waters |
| 2,923,014 | A | 2/1960 | Hume |
| 3,295,577 | A | 1/1967 | Danielson |
| 3,785,419 | A | 1/1974 | Sherlock |
| 4,328,271 | A | 5/1982 | Rountree |
| 4,396,227 | A | 8/1983 | Neilson |
| 4,627,363 | A | 12/1986 | Jones |
| 4,705,084 | A | 11/1987 | Rodebaugh et al. |
| 4,789,019 | A | 12/1988 | Sweetser et al. |
| 4,895,742 | A | 1/1990 | Schaub et al. |
| 5,069,554 | A | 12/1991 | Bonnett |
| 5,339,748 | A | 8/1994 | Bilotti |
| 5,733,002 | A | 3/1998 | Riley et al. |
| 5,778,802 | A | 7/1998 | Hairston et al. |
| 6,014,935 | A | 1/2000 | Willett |

*Primary Examiner*—Alexander S. Thomas
(74) *Attorney, Agent, or Firm*—Dann Dorfman Herrell and Skillman, P.C.

(57) ABSTRACT

A fabric cover generally corresponds to the shape of a selected table top and, when placed on the table top, exposes the table top, or any covering thereon beyond the peripheral edges of the fabric cover. Loop extensions periodically extend outward from the periphery of the fabric cover, at least to the edge of the table top and provide loops spaced from the periphery of the fabric cover for receiving ties. At least one decorative tie is fed through the loops and around the table top in decorative way so that adjacent ends of ties may be connected together in a decorative way between adjacent loop extensions. Various decorative detail may be added to the fabric cover and/or the extensions, such as embroidery or cut-outs, which may be left open or have an insert extending across part or all of the cut-out.

5 Claims, 3 Drawing Sheets

DECORATIVE TABLE COVERING

The present invention relates to a decorative table covering to be placed on the top of a table, but characteristically does not to cover the entire table top. For example, the table covering may not, and preferably does not, extend to the edges of the table top so as to allow the fine wood of the table to be seen when the decorative cover is used as the only cover. The covering can also be used as an overlay for a conventional table cloth or covering, allowing the display of the color, decoration, or design of the partially covered table covering beyond the edges of its covering.

The decorative table covering of the present invention has not been available in the prior art. The prior art reveals table coverings with a drawstring provided in a hem or sealed loop around its periphery except at access gaps which permit use of the drawstring. This has been a functional arrangement intended to hold a cloth, usually a plastic disposable cloth, on a table. For example, such an arrangement could be used to hold the covering on the table in windy conditions. In some cases, the drawstring can be loosened and reused to collect refuse on the table, such as used disposable utensils and plates, and uneaten food, in a sort of makeshift bag.

Coverings of this sort has been used functionally on other types of furniture as well to effect an approximate conformity of the cover to the shape of furniture being covered, using the drawstring to pull the edges together around a part or all of the furniture involved. When one is designing functionally, the purpose usually is to cover the whole top of the table, which typically may be a temporary table used outside. The concept is to keep the table covered as completely as possible so that table will not be soiled and to minimize cleanup.

The present invention is directed to a purpose other than a covering table cloth. In fact, the concept is to provide a decorative table cover to expose part of the table to show the wood of a fine table or to show perhaps an underlaying table cloth of contrasting color or texture, or for other decorative purposes. Additionally or alternatively, the decorative covering may be open or partially open at the center or other selected places to display the wood of the table or underlying covering. Such openings may be closed or partially closed with netting or lace or a transparent or semi-transparent fabric. The covering need not be made of conventional fabric, such as woven cloth, or other conventional table cloth materials, but it may be made of such materials. In any event, whatever the material used, it will be referred to herein as a fabric cover which will in most cases be a fabric which is capable of folding for storage without damage.

The fabric cover is provided with loop extensions periodically extending outward from the periphery of the cover and functioning to provide loops which extend to or beyond the edge of the table top. In many embodiments the loops will extend below the top to a recess or below the recess. The loop extensions may take various shapes and forms. They may be made of the same fabric as the table covering, or a different fabric. They may be integral with the table covering or attached by sewing, or with fasteners of various types. Likewise, the loops may be formed, in the extensions by sewing parts of the extension together, or by use of fastening devices, which themselves may be decorative. The loop extensions may be decorated by cut-outs, embroidery, or other techniques, either to carry over a theme used on the fabric covering or to introduce some design unrelated to anything on the fabric covering itself.

At least one decorative tie is provided to be threaded through the loops and to permit adjacent ends to be connected together in a decorative way between adjacent loop extensions. There may be a single tie, or two or more such ties, the ends of each of which has to be connected to the adjacent tie end. They may be connected together in various ways, but ultimately so that when the covering is in place, the decorative ties pull the tabs toward the table and in some cases beneath the tabletop. The ties may be used to secure the decorative covering to the table or make it more conforming, but often pulling the ties to tight may destroy the decorative effect.

More specifically, the present invention is directed to a decorative table covering providing a fabric cover generally corresponding to the shape of a selected table top. The concept is to have the covering of such size, that when placed on the table top, it will not extend to the edges, but will leave part of the table top visible. Loop extensions on the fabric cover periodically extend outward from the periphery of the fabric cover to provide closed loops which extend beyond the edge of the tabletop, and preferably below the top. In some cases the loops extend sufficiently below the tabletop so that the loops may be pulled into recesses below the table top. At least one decorative tie is fed through the loops and has its ends connected together in a decorative way between adjacent loops. A single tie may be employed in some instances which allows just one decorative connection of its ends. Often more than one tie may be used, because the connections providing a decorative feature may be made of decorative ribbon, velvet rope, or other material whose color, shape and/or texture adds to the decorative effect. There can also be alternative materials for ties such as chains, or leather belts. The ties may be made long enough to enable them to be tied into a decorative bow or bows at each connection. For example, the bows may be designed to be placed in the middle of opposite ends of the table, or the middle of the sides of the table, or at both locations. In some cases, many ties with many connections may be used all around the table. The connections, in addition to bows may be pins or clasps preferably of a decorative form which will enhance the esthetic effect of the covering as a whole. In view of the decorative nature of the ties they are normally not intended to be drawn tight around the table and may even be fastened between loops.

BRIEF DESCRIPTION OF THE DRAWINGS

The accompanying drawings provide examples of the present invention which are typical of its possible uses, in which.

SPECIFIC EMBODIMENTS

Figure 1:
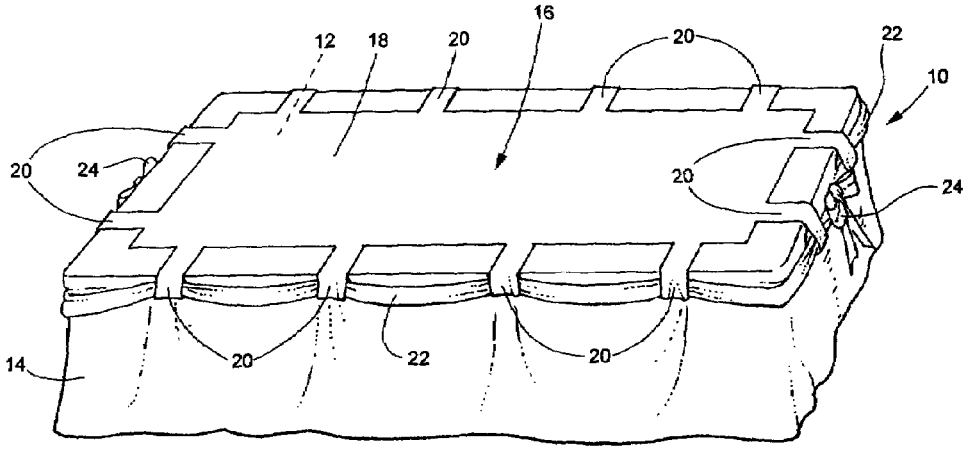
FIG. 1 represents a decorative perspective view of a table with a decorative covering of the present invention in place over an underlying table cloth wherein two decorative ties are used to provide connecting bows at opposite ends of the table as shown.

Referring now to the drawings in detail, FIG. 1 shows a table generally designated 10 having a rectangular top 12. In this arrangement, a tablecloth 14 which extends essentially to the floor is indicated. Alternatively, the covering may extend part way down to table and the legs of the table would be seen below the bottom edge of the table cloth. The table cloth 14 is not specifically part of the invention except to show that it is possible to have a table cloth covering on the table before putting the decorative table covering in place. The decorative table covering, generally designated 16, may be a fabric cover, such as shown which does not extend to the edges of the table top, thus allowing the underlying table cloth 14 to be seen. The decorative table covering and the table cloth it covers, may be of contrasting color, or of different material. The term "fabric" as used herein includes any flexible foldable material no matter how made, whether woven or non-woven, whether solid or perforated in various ways. The decorative covering 18 in this case is a plain rectangular piece conforming to the general shape of the table. In other embodiments it could be other shapes or have edges which are not straight, such as scalloped edges or other more elaborate design treatment of the edges. It could be a pierced table cloth with openings of designed pattern and shape. It could have inserts of net or lace. Contrasting effects can be achieved not only by differences in color, or using table cloth of curtain material, or other material which is generally translucent. If cut-outs are provided in the decorative covering, they may be left open or they may be closed with other material, such as, lace or netting. The covering may also be of non-woven material, including such exotic things as chains or leather belts.

Loop extensions 20 are provided periodically around the periphery of the decorative fabric cover extending from the periphery thereof and providing loops which extend beyond the edge of the table top. At least one decorative tie 22 is provided to be fed through the loops in the loop extensions 20 as shown and with adjacent ends connected together in a decorative way between the adjacent table ties. Care should be taken with the ties in most cases to avoid pulling them taunt. In fact, depending on the material color and finish of the tie, special decorative treatments may be used but they should be loose enough to give a festive effect of draping or festooning. The loop extensions may be arranged so that they are just over the edge of the table and even with such loose arrangement the ties extending below the corners of the table to help hold the decorative covering in place when pulled together. The adjacent ends of the ties are connected together in a decorative way, as by bows 24 or separate fasteners, which may also preferably be decorative.

Figure 3:
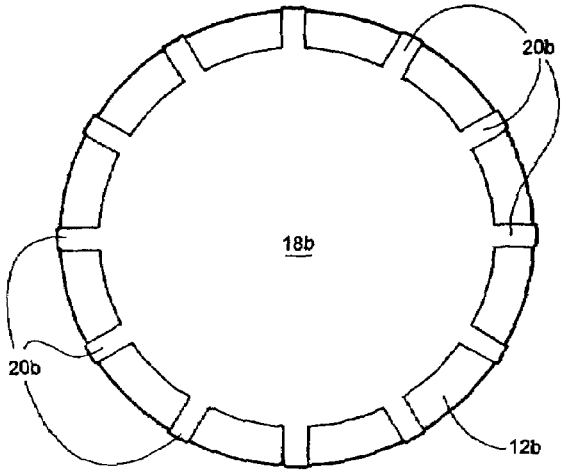
FIG. 3 is a plan view of a decorative table covering of the present invention for use on a round table.
Figure 2:
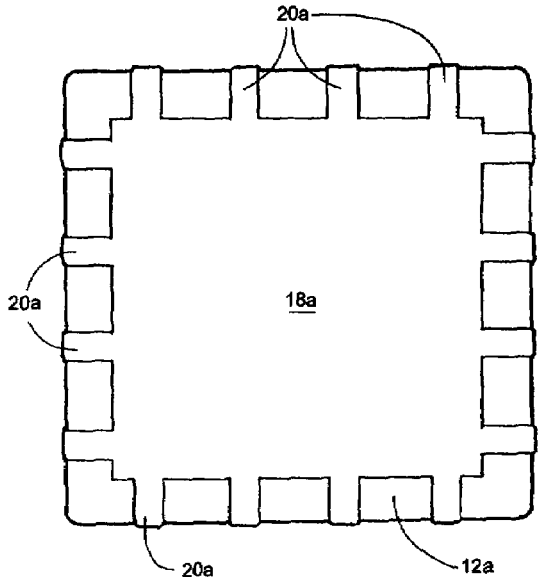
FIG. 2 is a plan view from above of a decorative fabric cover for use on a square table.

FIGS. 2 and 3 are decorative coverings for tables in modified shape. FIG. 2 shows the configuration for a square table and FIG. 3 for a round table. Assuming that there is no cover on either of the tables of FIGS. 2 and 3, the number designators employed are the same in FIG. 1 except those in FIG. 2 have a suffix of "a" and those in FIG. 2 a suffix of "b". Thus, the table 12*a* in FIG. 2 is a square table. The fabric cover 18*a* is shown as a square of smaller size so that the wood and finish of the table top may be seen beyond the edges of the decorative covering. The loop extensions 20*a* are shown as generally equally spaced and approximately the same number, here four along each side, as in the rectangular cover of FIG. 1. The loop extensions 20*a* can be cut out of the same piece of fabric composing the fabric cover 18*a*. Alternatively, the loop extensions 20*a* can be separate pieces secured to the fabric covering 18*a* by sewing or other appropriate means. In any event, each of them has a loop formed in the fabric or an added piece, such as a ring, which loop extends beyond the edge of the table so as to permit the one or more decorative tie to be drawn the loops through at the edge of the table. The bow or other connection means are below the table top and not seen when viewed from the opposite side of the table. In other case bows or connectors may be placed to be seen from the opposite end. In any event, such connectors will be understood to be part of the design as they are in FIG. 1.

FIG. 3 has a round fabric cover 18*b* somewhat smaller than the round table top so that the fabric below the cover or the wood of the table may be seen beyond the edge. The loop extensions 20*b,* as shown, are preferably arranged radially outward extending at regular intervals in the case of this round table. It may be more desirable in some cases that the loop extensions 20*b* extend sufficiently farther over the edge of the table to provide decorative effect well below the table top and in some cases the decorative tie can be used to pull the loops under the table top when put in place.

In any embodiment, the number of loop extensions is arbitrarily selected by a designer for the particular situation and the spacings may be different between various loop, usually as arranged in a repeated pattern around be decoration cover. For example, pairs of loop extensions may be closer together with intermediate pairs or single loop extension being separated from them further then they are from each other. The pattern in any case is preferably repeated regularly around the fabric cover 18*b*. In this or any case, there is no requirement that the loop extensions must be in a symmetrical pattern, although, in most cases such an arrangement would be preferred. It is desirable to have enough loop extensions at positions around the table to enable the tie to effectively help center the fabric cover, but the possibility exists than an off center fabric cover may be wanted for special effect and loop extensions will be of different lengths to help the ties keep the fabric cover in position. In this regard, it also is possible, even with the distribution of loop extensions as shown in FIG. 3, to have the peripheral edges of the cover 18*b,* for example, in a wave configuration. In that configuration every other loop extension has to be longer than intermediate extensions to reach beyond the edge of the table top. In addition to having different arrangements of the loop extensions from those shown, it is possible to have the loop extensions 20*b* to be of different material from the fabric cover 18*b* or some kind of contrast in cover or textures desired. Loop extensions may even be designed to different in color, texture, or other respects, from one another, but usually in a repeated pattern around the periphery of the decorative cover 18*b*.

Figure 4:
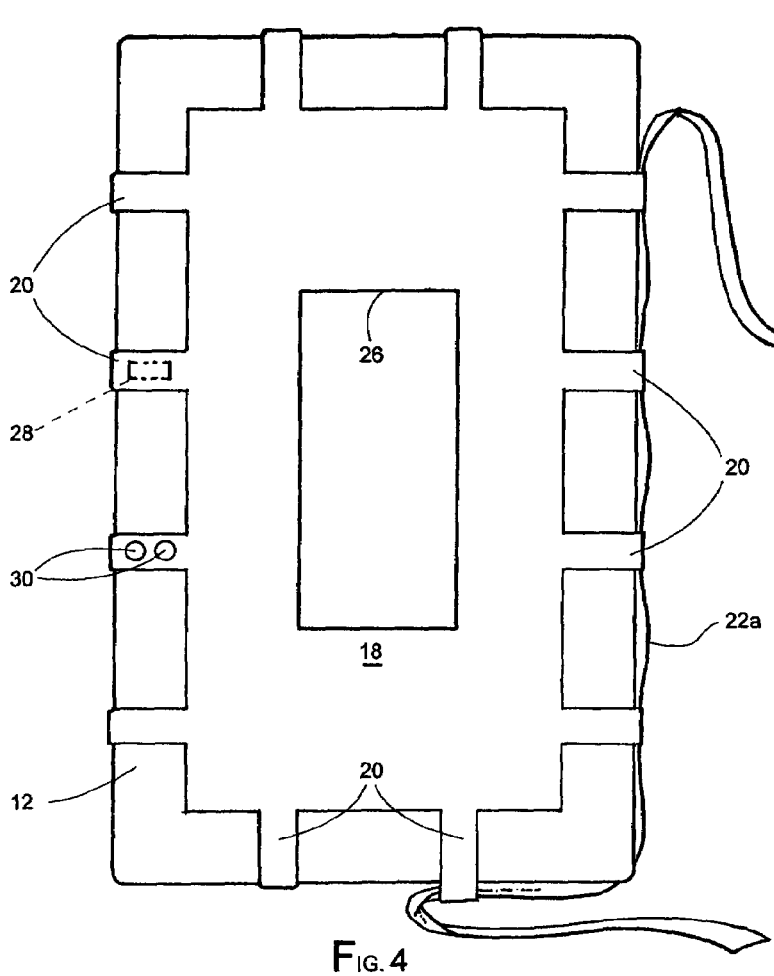
FIG. 4 shows a plan view from above of a decorative table covering such as the one shown in FIG. 1, but having a central rectangular cut out, with the cover in place and showing the decorative tie being fed through the loops.
Figure 5:
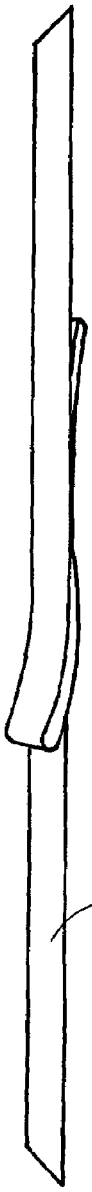
FIG. 5 shows somewhat in perspective, a similar ribbon type tie to be used on the other side of the table and fed through the loops in a way similar to that shown in FIG. 4.
Figure 6:
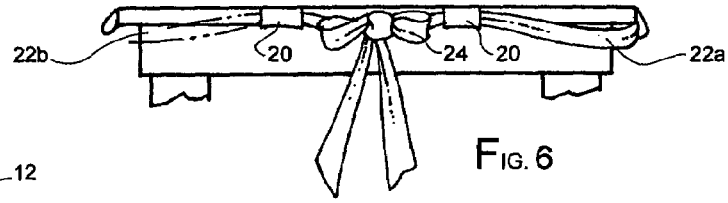
FIG. 6 is a partial elevational view of the top of the table of FIG. 4 from one end with the decorative fabric cover in place and the decorative ties installed and tied into a bow at the end shown.
Figure 7:
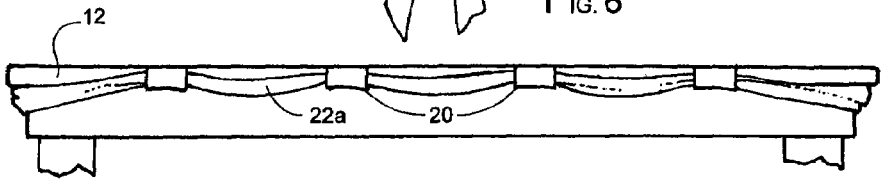
FIG. 7 is a partial elevational view of the top of the table of FIG. 4 from one side with the decorative fabric cover in place and the decorative ties installed.

FIG. 4 is a plan view of the decorative covering of FIG. 1. Except in this case, a central opening 26 of rectangular shape is shown. In other respects, the configuration may be similar and are, therefor, given similar number designators as in FIG. 1. In this case, the decorative ties 22 are numbered as they were in the case of FIG. 1. However, in this FIG. 1 the tie 22*a* is shown being partially threaded through the loops on one side, is designated 22*a.* The tie 22*b* shown in FIG. 5 is to be threaded through the loops shown on the other side. Then the ties 22*a* and 22*b* may be connected together as shown in FIG. 6 in a bow 24, and another bow 24 at the other end of the table. Assuming that the table cloth covering 14 is omitted in these figures, the natural wood of the table top 12 will be seen. The appearance of the tie along the side of the table is shown in FIG. 7.

Since the tie is intended to be part of the decorative arrangement, it can be made of ribbons which are differently colored, perhaps brightly colored, from the fabric cover. The ribbon may be silk, or velvet for special effect as desired. There can also be alternative materials for ties such as chains or leather belts. The tie can also be round or other shape in cross section.

The cut-out 26 is intended to provide another opportunity to see the table wood and finish in addition to the exposed area around the periphery. However, since the pull of the decorative ties may cause a distortion of the fabric cover 18, it may preferably be provided with an insert of material which can be seen through, entirely or partially, but will provide some structural strength to prevent distortion of the fabric cover. Alternatively, instead of a cut out area, the rectangular area may represent an applique piece of material, possibly of different color or texture. In such case the underlying fabric covering need not be cut away. Further, it will be understood that multiple openings or multiple instances of applique or embroidery can be employed. In fact, other symmetrical or asymmetrical cutouts or patterns of cutouts or design applique may be used. The particular configuration of FIG. 4 simply suggests possibilities by being way of example and not limitation.

Similarly, the loop extensions 20 may be integral with the decorative covering 18 or attached to it. If attached, pieces of the same material or of different materials, or material of different color, etc., can possibly be used. The loop extensions may also be embellished with designs which may be applied similarly to each of them or periodically the designs may be different on each extension or of a limited variety in a sequence symmetrically arranged. All kinds of possibilities are possible, of course. The dashed rectangle 28 represents a pattern which may be either an applique or embroidery or cutout, with or without some sort of insert. The pair of circular designs or openings 30 in another tab can be similarly repeated in various ways, or alternated with a pattern like 28 or another pattern. Stitched designs may also have a functional purpose, such as providing a means of attachment of the end of the loop extension to itself to form the loop. Other possibilities of such structure are shown in FIGS. 8*a,* 8*b,* and 8*c.*

The loop extension shown in 8*a,* 8*b,* and 8*c* are basically the extensions 20 of FIGS. 1–7, but are given separate numbers. In each case, just a corner of the table top 12 is shown plus a corner of the fabric cover 18. Each loop extension is attached preferably by sewing. The dashed lines 33 represent the stitched hemming along the edge which may be sufficient. In practice, probably additional stitching would be applied.

Figure 8A:
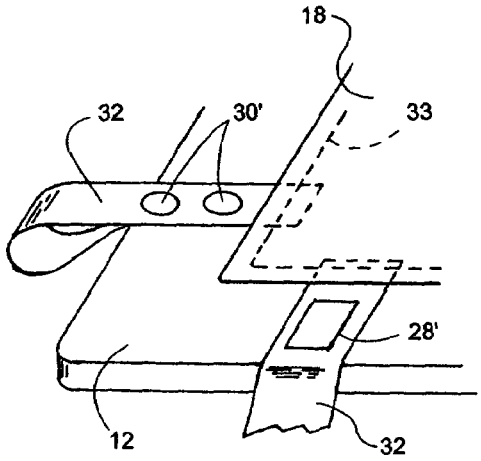
FIGS. 8*a,* 8*b,* and 8*c* each show partial perspective views of a corner of a table with the decorative covering in place, alternative treatments of decorative loop extensions at the corner of the table top in each case.

In FIG. 8*a,* loop extensions 32 are intended to be of the same general pattern or design. The loop is formed by folding the extension fabric back on itself and the overlapping pieces are sewn together, possibly using some kind of decorative stitching, similar to the pattern 30, on one of the extensions 20 in FIG. 4.

Figure 8B:
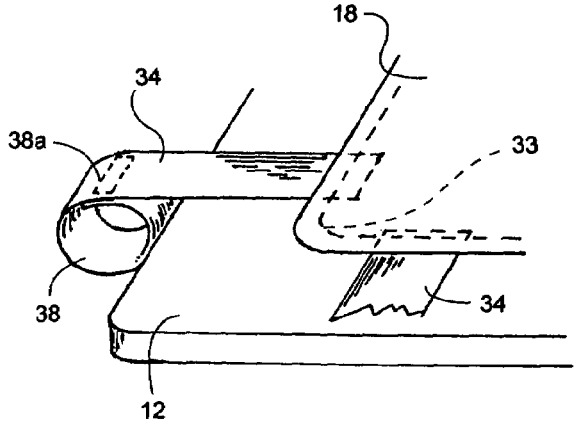

FIG. 8*b* shows loop extension 34 having a somewhat different kind of loop in that the loop is rolled into an essentially circular loop 38 and overlapping parts of extension 34 may be held in place by stitching 38*a* as shown, or otherwise secured.

Figure 8C:
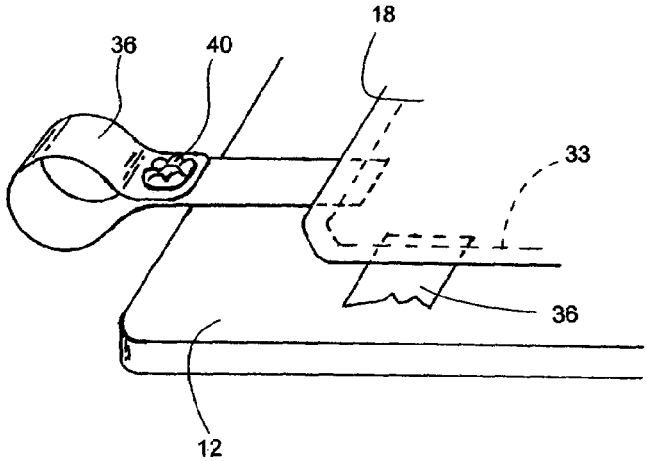

FIG. 8*c* shows a loop formed similar to that of FIG. 8*a* but with the end of the loop extension 36 being folded back on top of the extension with the loop being formed by securing overlapping parts of the extension 36 by a decorative fastener 40 applied through the two layers of the extension near its respective end.

It will be understood by those skilled in the art that many variations in the loop patterns shown here may be used. All kinds of attachments of the loop extensions are possible both to the fabric cover and back to themselves to form the loop. As mentioned above, it is also possible to make the loop extensions integral with the fabric of the fabric cover so that stitching them together is not necessary, although some kind of reinforcement stitching may be employed. The loop may also be provided by a metal or plastic ring secured to the end of the extension.

The applicant has suggested a number of ways in which variations on the invention may be undertaken. All such variations within the scope of the claims are intended to be within the scope of the present invention, whether actually shown in drawings or mentioned as alternatives in the specification but are within the skill of the tailor making the cover.

I claim:

1. A method of decorating and using a fabric cover generally corresponding to a table top of selected shape but smaller such that on the table top it will expose parts of the table top, or any covering thereon, beyond the peripheral edges of the fabric cover except for loop extensions periodically extending from the periphery of the fabric cover to the edge of the table top, which loop extensions are narrow relative to lateral spacing between the extensions and provide loops for supporting ties spaced from the fabric cover, near the edge of the table top, and at least one decorative tie, comprising the steps of:

feeding the tie through the loops and placing the fabric cover on the table top in position for the loop extensions to extend at least to the edge of the table, and arranging the tie near the edge of the table top so that at least between the loop extensions the tie will drape down from the edge, connecting adjacent ends of the ties to one another in such a way that the completed tie remains loose and slack and able to be viewed between adjacent loop extensions, and, arranging the ties between loops to be drooping, and easily visible throughout their length between the loops.

2. The method of claim 1 in which the means of connecting adjacent ends of the ties together is tying them into bows.

3. The method of claim 2 in which the tie is made of multiple segments in series such that the multiple connections of adjacent ends are made by tying the adjacent ends together.

4. The method of claim 1 in which the means of connecting the adjacent ends of the tie together is a separate decorative connector means.

5. The method of claim 4 in which the tie is made of multiple segments in series such that each of the multiple connections of adjacent ends is made by separate connectors.

* * * * *